US009000287B1

(12) United States Patent
Andersen et al.

(10) Patent No.: US 9,000,287 B1
(45) Date of Patent: Apr. 7, 2015

(54) ELECTRICAL GUITAR INTERFACE METHOD AND SYSTEM

(71) Applicants: Mark Andersen, Los Angeles, CA (US); John Vito Biondo, Sherman Oaks, CA (US)

(72) Inventors: Mark Andersen, Los Angeles, CA (US); John Vito Biondo, Sherman Oaks, CA (US)

(73) Assignee: Mark Andersen, Los Angeles, CA (US)

( * ) Notice: Subject to any disclaimer, the term of this patent is extended or adjusted under 35 U.S.C. 154(b) by 0 days.

(21) Appl. No.: 14/076,080

(22) Filed: Nov. 8, 2013

Related U.S. Application Data

(60) Provisional application No. 61/723,909, filed on Nov. 8, 2012.

(51) Int. Cl.
*G10H 1/34* (2006.01)
*G10H 3/18* (2006.01)
*G10H 1/02* (2006.01)

(52) U.S. Cl.
CPC ..... *G10H 1/02* (2013.01)

(58) Field of Classification Search
USPC ..... 84/622, 623, 659, 665, 725, 727
See application file for complete search history.

(56) References Cited

U.S. PATENT DOCUMENTS 4,481,854 A * 11/1984 Dugas ..... 84/736
5,837,912 A * 11/1998 Eagen ..... 84/267
6,191,348 B1 * 2/2001 Johnson ..... 84/485 R
6,687,193 B2 * 2/2004 Jung ..... 369/4
7,355,110 B2 * 4/2008 Nash ..... 84/601
7,521,628 B2 * 4/2009 Armstrong-Muntner ..... 84/737
7,541,536 B2 * 6/2009 Daniel ..... 84/626
8,093,486 B2 * 1/2012 Behringer et al. ..... 84/615
8,193,437 B2 * 6/2012 Mizuhiki ..... 84/622
8,481,832 B2 * 7/2013 Lloyd ..... 84/329
8,519,250 B2 * 8/2013 Ludwig ..... 84/645
8,710,346 B2 * 4/2014 Behringer et al. ..... 84/644
8,827,806 B2 * 9/2014 McCauley et al. ..... 463/36
2004/0099131 A1 * 5/2004 Ludwig ..... 84/723
2005/0183566 A1 * 8/2005 Nash ..... 84/601
2006/0101987 A1 * 5/2006 Celi et al. ..... 84/723
2007/0000375 A1 * 1/2007 Harrison ..... 84/737
2007/0131100 A1 * 6/2007 Daniel ..... 84/737
2007/0131101 A1 * 6/2007 Doering ..... 84/737
2007/0251374 A1 * 11/2007 Armstrong-Muntner ..... 84/735
2008/0271594 A1 * 11/2008 Starr ..... 84/646
2009/0139390 A1 * 6/2009 Raisanen ..... 84/737
2009/0288543 A1 * 11/2009 Bar-Ilan ..... 84/290
2010/0275761 A1 * 11/2010 Ierymenko ..... 84/731
2010/0288108 A1 * 11/2010 Jung et al. ..... 84/610
2011/0005367 A1 * 1/2011 Hwang et al. ..... 84/314 R
2011/0088535 A1 * 4/2011 Zarimis ..... 84/645
2011/0100198 A1 * 5/2011 Gatzsche et al. ..... 84/615
2011/0146477 A1 * 6/2011 Tsukamoto ..... 84/485 R
2011/0283868 A1 * 11/2011 Behringer et al. ..... 84/622
2012/0036982 A1 * 2/2012 Sullivan ..... 84/724
2012/0139861 A1 * 6/2012 Jung et al. ..... 345/173

(Continued)

*Primary Examiner* — David S. Warren
(74) *Attorney, Agent, or Firm* — David L. Hoffman; Hoffman Patent Group

(57) ABSTRACT

In some embodiments, an electric guitar interface system, includes a first touchpad of an electric guitar configured to detect a user input, and a control unit coupled to the first touchpad. The control unit may be configured to set a first parameter of the electric guitar's output as a function of a position of the user input along the first axis. The first parameter includes a first pickup gain. The first pickup gain may be for at least one of a bridge pickup, a middle pickup, and a neck pickup. The first parameter includes a second pickup gain.

20 Claims, 21 Drawing Sheets

(56) References Cited

U.S. PATENT DOCUMENTS

| | | | | |
|---|---|---|---|---|
| 2012/0194994 | A1* | 8/2012 | Lloyd | 361/679.41 |
| 2012/0240751 | A1* | 9/2012 | Yonetani | 84/726 |
| 2012/0297962 | A1* | 11/2012 | O'Donnell et al. | 84/645 |
| 2012/0318121 | A1* | 12/2012 | Mittelstadt et al. | 84/743 |
| 2013/0074680 | A1* | 3/2013 | Elion | 84/646 |
| 2013/0118337 | A1* | 5/2013 | Behringer et al. | 84/615 |
| 2013/0174717 | A1* | 7/2013 | Butera et al. | 84/609 |
| 2013/0255474 | A1* | 10/2013 | Hanks | 84/615 |
| 2013/0263721 | A1* | 10/2013 | Shavit | 84/626 |
| 2013/0305905 | A1* | 11/2013 | Barkley et al. | 84/609 |
| 2014/0150630 | A1* | 6/2014 | Juszkiewicz | 84/626 |
| 2014/0202315 | A1* | 7/2014 | Behringer et al. | 84/615 |
| 2014/0202316 | A1* | 7/2014 | Szalay et al. | 84/645 |

* cited by examiner

SINGLE VARIABLES THAT MAY BE CONTROLLED BY POSITION ALONG THE SINGLE AXIS

| |
|---|
| VOLUME |
| TONE |
| PICKUPS |
| OTHER PARAMETERS |

TWO PERPENDICULAR AXES

PAIRS OF VARIABLES THAT MAY CORRESPOND TO THE TWO PERPENDICULAR AXES

| | |
|---|---|
| VOLUME | VOLUME |
| TONE | TONE |
| PICKUPS | PICKUPS |
| OTHER PARAMETERS | OTHER PARAMETERS |

| | |
|---|---|
| VOLUME | TONE |
| VOLUME | PICKUPS |
| TONE | PICKUPS |
| OTHER PARAMETERS | OTHER PARAMETERS |

ELECTRICAL GUITAR INTERFACE METHOD AND SYSTEM

CROSS REFERENCE TO RELATED APPLICATION

This application claims the benefit of U.S. provisional application Ser. No. 61/723,909, filed on Nov. 8, 2012, the entirety of which is incorporated herein by reference.

BACKGROUND

1. Technical Field

The present invention relates to an interface method and system, and more particularly to an electric guitar interface method and system.

2. Description of the Related Art

Traditional electric guitars use potentiometers for controlling volume and tone, and a switch for determining which pickups of an electric guitar (e.g., bridge, middle, neck) are to be used. These traditional interfaces are typically placed on the body of the guitar face out of the way of a player's hand that moves a guitar pick across the guitar strings. Guitar players must learn to play the strings in a particular way to avoid bumping the knobs and switch used to control volume, tone, and pickup settings. At a more advanced level, a guitar player can adjust volume, tone, and pickup while playing their guitar, but such movement involves being able to reach down to find the mechanical interface for the knob or switch, moving the knob or switch in the appropriate amount, and returning the controlling hand to playing the guitar. Such movements may be too difficult for novice or intermediate players to attempt, and may limit the ability of even advanced guitar players to modify volume and tone and pickups while playing the guitar.

SUMMARY

In an aspect, an electric guitar interface system includes a first touchpad of an electric guitar configured to detect a user input, and a control unit coupled to the first touchpad. The control unit is configured to set a first parameter of the electric guitar's output as a function of a position of the user input along the first axis, and the first parameter includes a first pickup gain.

The first pickup gain may be for at least one of a bridge pickup, a middle pickup, and a neck pickup. The first parameter may include a second pickup gain and/or a third pickup gain.

The electric guitar interface system of claim 1, wherein the first parameter includes a third pickup gain.

The control unit may be configured to control a second parameter of the electric guitar's output as a function of the position of the user input along the second axis. The second parameter may be one of volume and tone.

The electric guitar interface system may further include a touchpad housing that comprises at least one of a pickguard, an inlay, and an underlay. The first corresponding value may vary nonlinearly with respect to the position of the user input along the first axis.

The length of the first touchpad along the first axis may be divided into at least two segments, wherein the first corresponding value is constant for the length of the first segment along the first axis, and wherein the first corresponding value varies for the length of the second segment along the first axis.

The length of the first touchpad along the first axis includes a first segment in which the first corresponding value varies along the first axis, the first segment includes a first subsegment and a second subsegment that each have the same length and are adjacent to each other, and a range of the first corresponding value is greater in the second subsegment than in the first subsegment. The first segment may include a third subsegment that is adjacent to the second segment and has the same length as the first subsegment and the second subsegment. The range of the first corresponding value is greater in the third subsegment than in the second subsegment.

The electric guitar interface system of claim 10, wherein the first segment includes a third subsegment that is adjacent to the second segment and has the same length as the first subsegment and the second subsegment. The range of the first corresponding value may be smaller or larger in the third subsegment than in the second subsegment.

In another aspect, an electric guitar interface method includes using a first touchpad of an electric guitar, detecting a user input, and setting a first parameter of the electric guitar's output as a function of a position of the user input along the first axis. The first parameter may include a first pickup gain, which may be for at least one of a bridge pickup, a middle pickup, and a neck pickup. The first parameter may include a second pickup gain and/or a third pickup gain. The control unit may be configured to control a second parameter of the electric guitar's output as a function of the position of the user input along the second axis. The second parameter may be one of volume and tone.

In another aspect, a non-transitory tangible machine-readable medium is provided that has a set of instructions stored thereon that when executed by one or more processing devices cause the one or more processors to perform the method. The method includes using a first touchpad of an electric guitar, detecting a user input, and setting a first parameter of the electric guitar's output as a function of a position of the user input along the first axis. The first parameter may include a first pickup gain, which may be for at least one of a bridge pickup, a middle pickup, and a neck pickup. The first parameter may include a second pickup gain and/or a third pickup gain. The control unit may be configured to control a second parameter of the electric guitar's output as a function of the position of the user input along the second axis. The second parameter may be one of volume and tone.

DESCRIPTION OF EXEMPLARY EMBODIMENTS

Figure 1A:
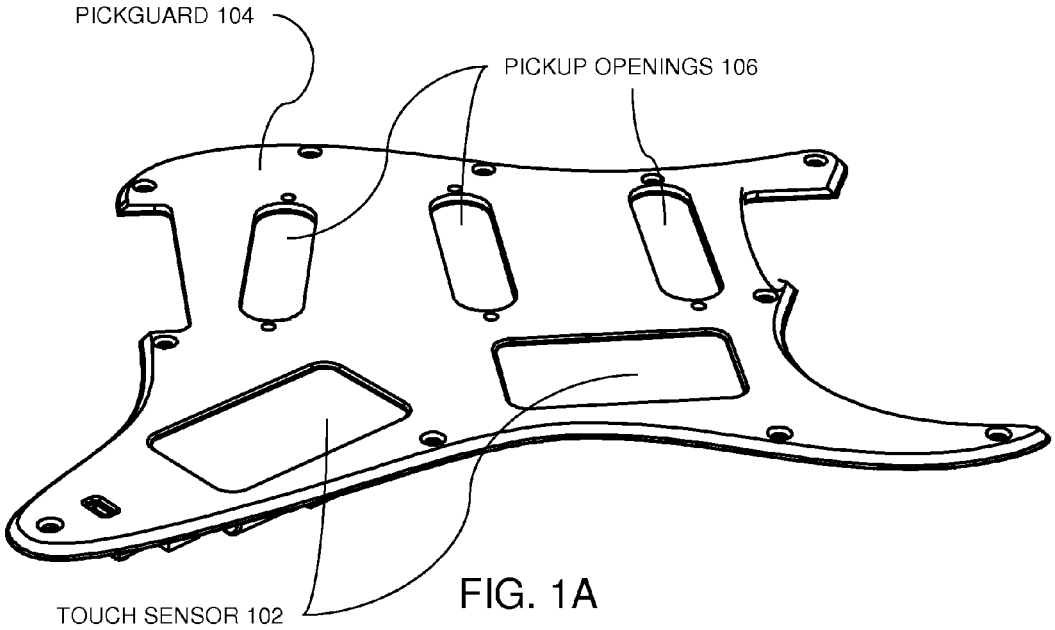
FIGS. 1A and 1B are upper and lower views of a pickguard with touch sensors, according to an embodiment.

Exemplary embodiments of the invention are described in detail below. Note that the following exemplary embodiments do not in any way limit the scope of the invention. Note also that all of the elements described in connection with the following exemplary embodiments should not necessarily be taken as essential elements of the invention.

I. System Overview

In some embodiments, the system and method converts any new or existing electric bass or electric guitar to a touch control interface. In other embodiments, the system and method may be installed and assembled with the guitar during its original construction.

The system may include a replacement or custom pickguard and/or pickguard housing with installed controls and PCB.

In preferred embodiments, the system includes one or more touchpads (e.g., touch sensors). Some examples of touch sensors that may be used include a resistive touchpad, a capacitive touchpad, and/or other types of touch sensors. Other sensing mechanisms that may be used include an infrared grid, infrared projection, acoustic pulse recognition, optical imaging, and dispersive signal technology. The one or more touchpads may be positioned at and/or oriented along preferred strum paths, which may make user control more intuitive and/or easier to perform. The size and shape of the one or more touchpads may depend on their location and function.

Circuits for receiving and/or interpreting the touchpad input may be analog, digital, and/or microprocessor controlled. The panel parameters may be preset, established, and/or adjusted in accordance with user control settings Embodiments of the invention include the use of touch sensors that may be placed on (and/or in) the pickguard and/or body of a guitar to control: 1) volume; 2) tone; and/or 3) pickup distribution for two or more sets of pickups. In some embodiments, pickup distribution for one or more pickups and/or sets of pickups may also be included. Touching or sliding contact between the guitar player and the touch sensor causes a change in the controlled parameter. The guitar player may use a finger, fingertip, hand, or guitar pick to contact the touch sensor.

In an embodiment, three different touch sensors are used to control each of volume, tone, and guitar pickups. Each sensor operates along a single axis, and touching or sliding a contacting surface at different positions along the respective touch sensor increases or decreases the controlled parameter.

In an embodiment, a multi-axis touch sensor is used to control a single parameter, such as volume, with variations in volume at different locations for the touchpad.

In an embodiment, a multi-axis touch sensor is used to control two parameters such as volume and tone. For example, volume and tone may be respectively controlled by horizontal and vertical placement of a contact surface on the touch sensor. A second sensor may be used to control the guitar pickups.

In various embodiments, the touch sensor(s) may be placed in proximity to the player's hand that strums the guitar strings. The touch sensor(s) may be located on the pickguard and/or the guitar body at a position covered by the projection of the guitar player's hand during normal strumming operations.

In some embodiments, the touch sensors are controlled without a microprocessor to avoid noise that may otherwise be generated by circuitry and computational elements.

II. Detailed Description of Embodiments with Respect to Figures

Figure 1B:
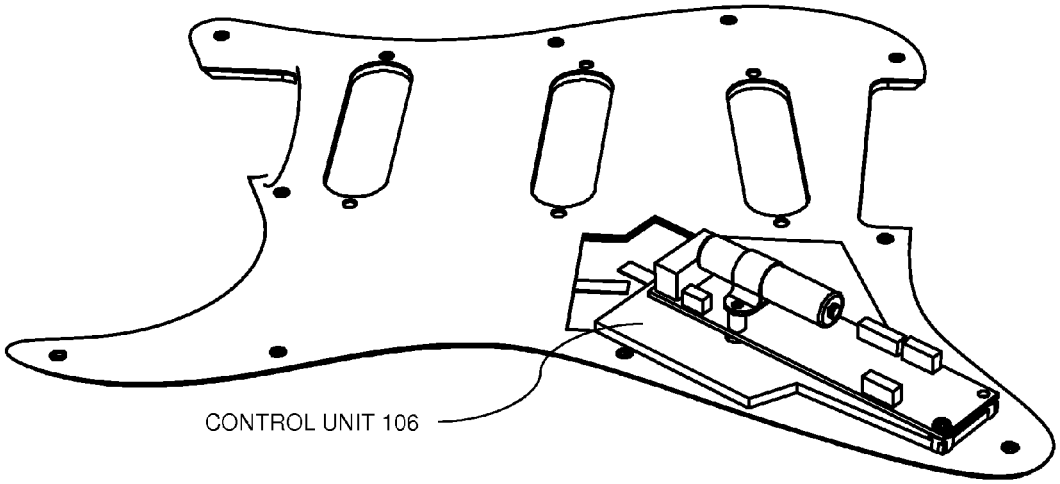

FIGS. 1A and 1B are upper and lower views of a pickguard with touch sensors, according to an embodiment. FIGS. 1A and 1B include touch sensors 102, the pickguard 104, pickup openings 106, and a control unit 106. As illustrated, the system may include a pair of touch sensors 102 and a control unit 106 that are mounted to a pickguard. The touch sensors 102 may be rectangular and aligned or angled with respect to each other. The touch sensors 102 may also have other shapes, such as ovals, curved lines, etc.

Figure 2A:
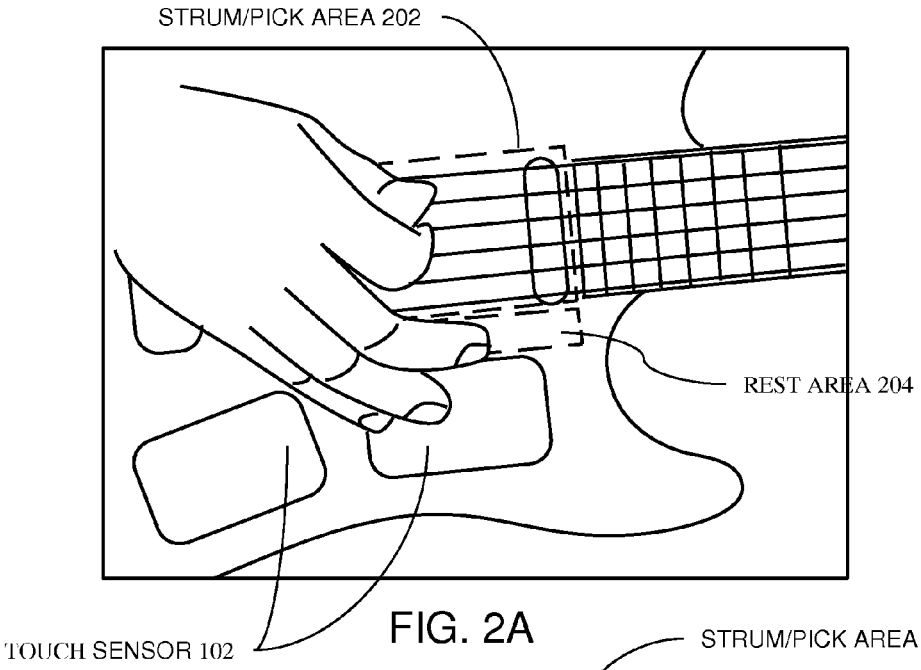
FIGS. 2A and 2B are illustrations of a user playing a guitar that includes touch sensors, according to an embodiment.
Figure 2B:
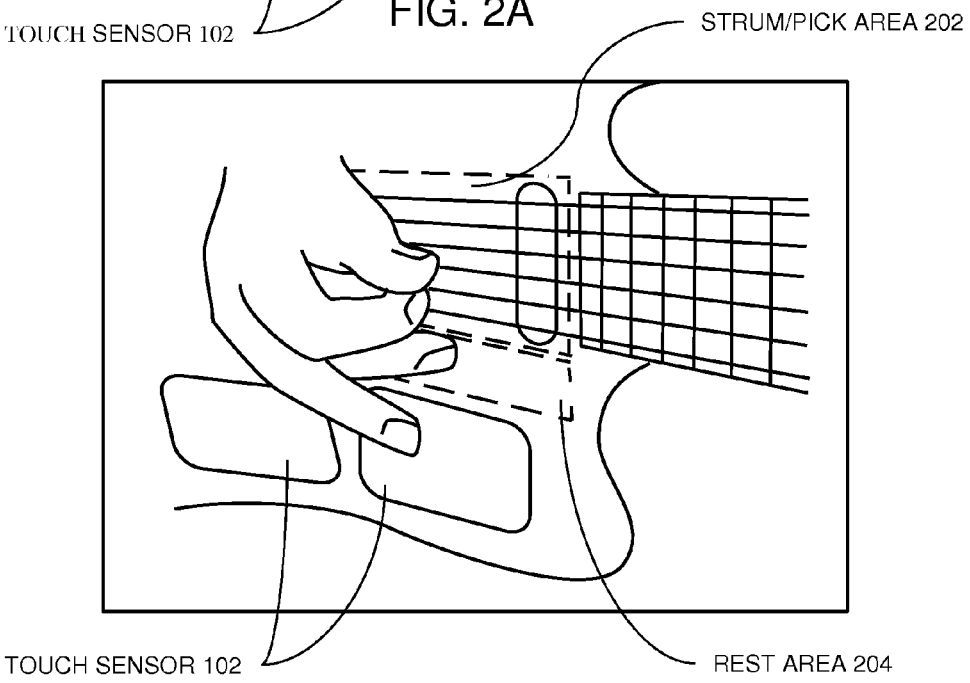

FIGS. 2A and 2B are illustrations of a user playing a guitar that includes touch sensors, according to an embodiment. As shown, the system may involve use of a strumming and/or picking area 202, a resting area 204, and the touch sensors 102.

The strumming/picking area 202 may be where a user can strum or pick the strings of an electric guitar, such as over or between particular pickups (e.g., bridge, middle, neck pickups). The resting area 204 may be disposed between the strum/pick area 202 and one or more of the touch sensors 102.

Figures 3A, 3B:
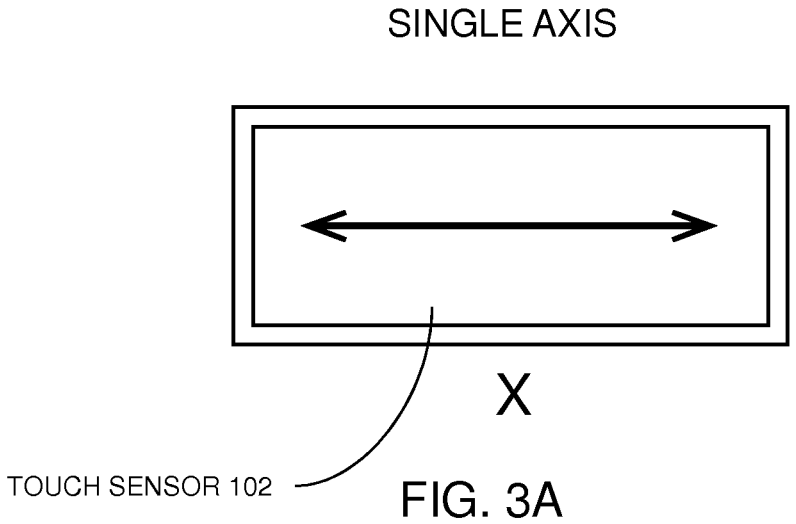
FIGS. 3A and 3B include illustrations of a single axis touchpad and possible variables, according to an embodiment.

FIGS. 3A and 3B include illustrations of a single axis touchpad and possible variables, according to an embodiment.

In the embodiment of FIG. 3A, a touchpad extends along an X-axis (e.g., a first axis, a second axis, etc.). The X-axis is shown as being parallel with a longer side of a rectangular touch sensor 102, but the X-axis may have other orientations (e.g., angled, perpendicular) with respect to the touch sensor 102, and the touch sensor 102 may have other forms in other embodiments. The X-axis is shown as being straight in this embodiment, but may also be curved, circular, or take other forms.

The touchpad may be configured to register inputs at varying locations along the X-axis and to provide varying outputs in accordance with the one or more locations where the touchpad is being contacted. The varying output may be a first gradient that extends along the X-axis. For the embodiment of FIG. 3A, contact with the touchpad at varying locations along the X-axis and/or Y-axis may provide results that correspond to the appropriate X-axis location. That is, changing position along the X-axis may cause varied control inputs and corresponding outputs, but contact with the touchpad at varying Y-axis locations for any given X-axis coordinate will produce the same output that corresponds to the X-axis coordinate.

Figure 7A:
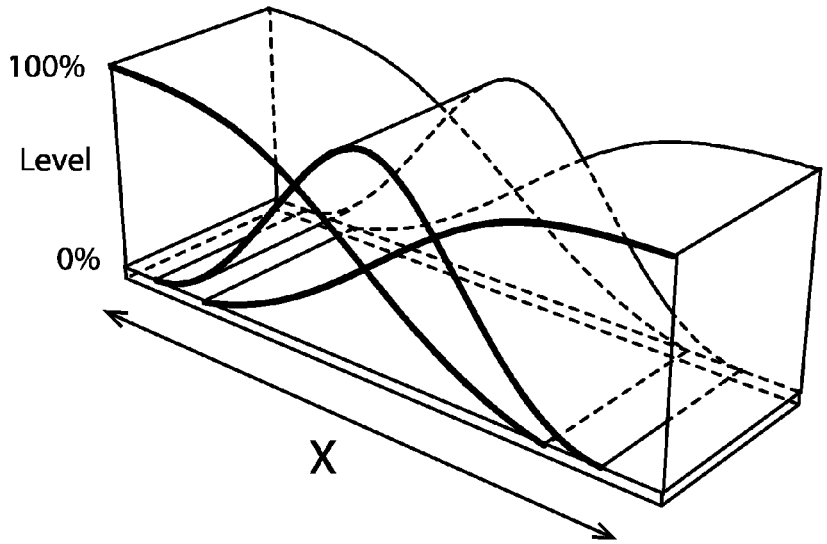
FIGS. 7A and 7B include illustrations of gradient distributions from different perspectives, according to an embodiment.

Some of the parameters that may be controlled by the touchpad of FIG. 7A may be volume, tone, or the modulation of one or more sets of pickups (e.g., bridge, neck, middle) for the electric instrument, as shown in FIG. 3B.

FIG. 3A shows a touch sensor and an orientation of a single axis X.

Figures 4A, 4B, 4C:
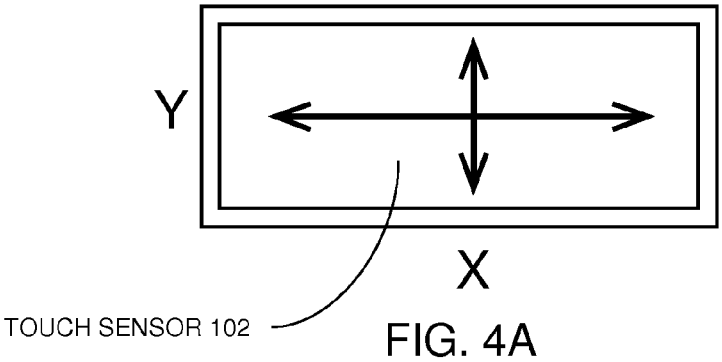
FIGS. 4A, 4B, and 4C include illustrations of a dual axis touchpad and possible variables, according to an embodiment.

FIGS. 4A, 4B, and 4C include illustrations of a dual axis touchpad and possible variables, according to an embodiment.

In the embodiment of FIGS. 4A, 4B, and 4C, a first gradient extends along the X-axis, and a second gradient extends along the Y-axis. As illustrated the X-axis and the Y-axis are perpendicular to each other. In other embodiments, the axes may have different relative angles.

FIGS. 4B and 4C show combinations of parameters that may be assigned to each of the gradients. As shown in FIG. 4B, both gradients may be used to control volume, tone, or pickup distribution. For example, the top edge and the right edge of the touchpad may correspond to a maximum volume output, while the bottom edge and the left edge of the touchpad correspond to a lowest volume setting. Other potential variations are possible, and are described in greater detail below.

FIG. 4C illustrates other possible combinations of parameters that may be assigned to two different gradients for the same touchpad. For example, one gradient may relate to volume control, while another gradient relates to tone or pickup level. In another embodiment, one gradient relates to tone, and the second gradient relates to pickup level.

Exemplary Gradients and Control Systems

Figure 5A:
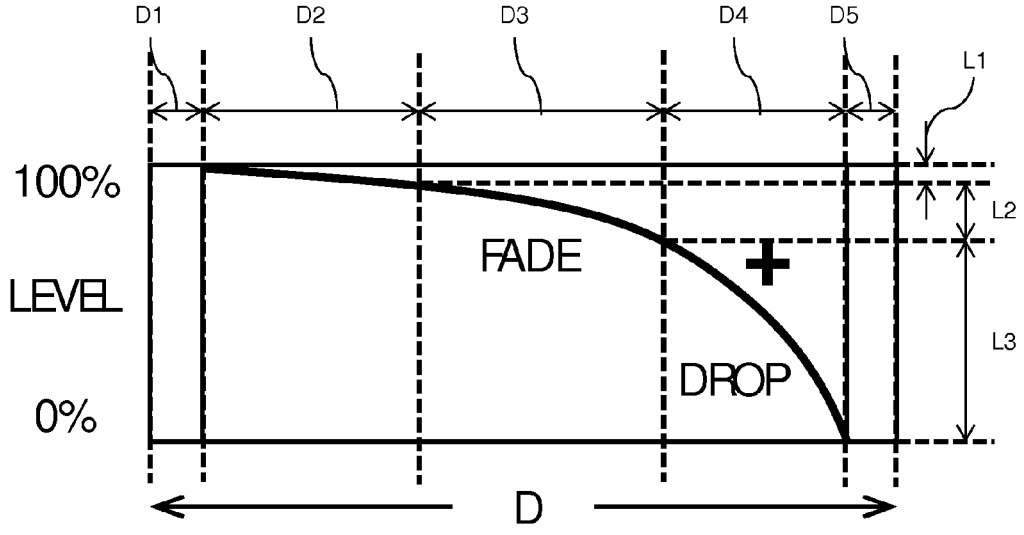
FIGS. 5A, 5B, and 5C illustrate possible gradient distributions along an axis, according to various embodiments.
Figure 5B:
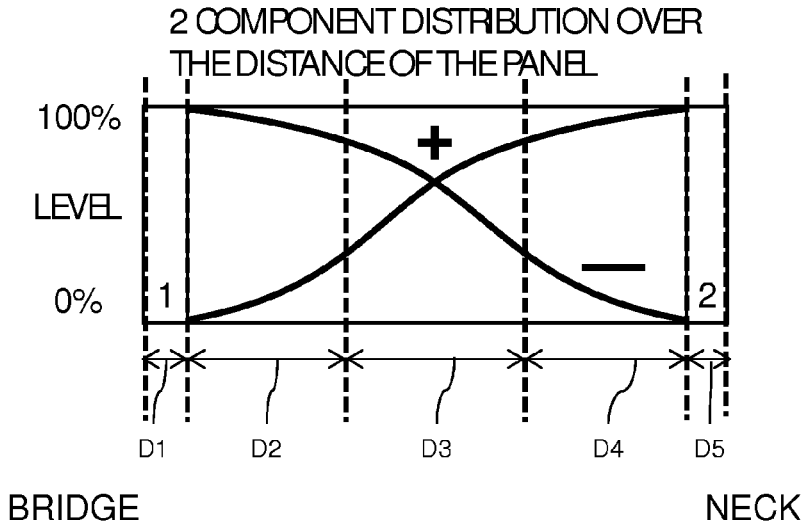
Figure 5C:
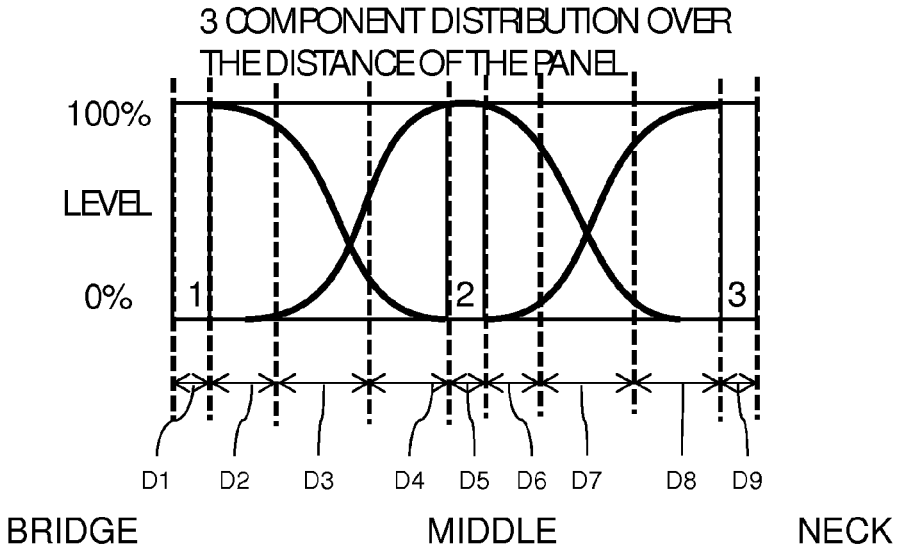

FIGS. 5A, 5B, and 5C illustrate possible gradient distributions along an axis, according to various embodiments.

FIG. 5A illustrates one arrangement for control of a parameter. In the embodiment, a touchpad may extend along an X-axis (as shown in FIG. 3A), and include a first end and a second end. The touchpad may further include an intermediate area that can be divided into two, three, or more segments (e.g., D2, D3, D4, etc.). The intermediate area may range between at an intermediate start (e.g., between D1 and D2) and an intermediate end (e.g., between D4 and D5), although movement along the touchpad or other actions performed using the touchpad may begin or end at either position and/or positions in between the intermediate start and the intermediate end.

In the end zones (e.g., D1 and D5), the gradient (e.g., the parameter curve) may not vary. The end zones may provide a touchable area that permits quick access to a preset level for the parameter. For example, one end may correspond to zero volume, while the opposite end of the touchpad corresponds to maximum volume. The parameter being controlled may be any one of volume, tone, or pickup level.

In the intermediate area of the touchpad, the gradient (e.g., the parameter curve or line as a function of position) may vary linearly or non-linearly. For example, the gradient may vary in accordance with an equation, such as a polynomial equation or a logarithmic equation. For example, the change in parameter level as a function of position along an axis may be similar to a parabolic curve, or a logarithmic curve. The gradient may also vary within a threshold amount of an equation, such as plus or minus 5%, 10%, or 15% of a given equation value. The gradient may correspond to experimentally derived values rather than or in addition to an equation.

In some embodiments, the intermediate area may be divided into two or more segments (e.g., subsegments of the intermediate area) that extend along the X-axis. The change in parameter level may increase per unit distance along the X-axis as the position of contact between the user's finger and the touchpad approaches the end region. The first segment (e.g., D2) may be longer than or the same length as the second segment (e.g., D3) and/or third segment (e.g., D4), which may provide a user with finer and slower control over parameter levels using the first segment, and coarser but faster parameter level control when using the second segment.

For example, when the user moves their finger between the start and the first threshold distance (D2 and D3) at a steady speed, the parameter level may vary between 100% (or another start level) and the first parameter level (e.g., 75%, L1 and L2, etc.) at a particular rate. The gradient (e.g., the parameter curve) may change more rapidly as the user's finger approaches and moves through the second segment. When the user moves their finger between the first threshold distance and the end (D4) at the same steady speed, the parameter level may vary between the first parameter level and 0% (or another selected level) with a faster rate of change than while the user's finger was moving across the first segment.

In an exemplary embodiment, as illustrated in FIG. 5A, the parameter level may vary between 100% output and first parameter level (e.g., 75%) between an intermediate start and a first threshold distance (e.g., approximately 66% of the length of the intermediate area). Between the first threshold distance and an intermediate end, the parameter level may vary between the first parameter level and 0%. In other embodiments, the start and end may be at other predetermined values ranging between 100% and 0%.

The intermediate area may be divided into three or more segments (e.g., D2, D3, D4). As discussed above in the embodiment with the intermediate area divided into two segments, the parameter level may vary between 100% and a first parameter level (e.g., through L1) between an intermediate start and the first threshold distance (e.g., through D2). Between the first threshold distance and the second threshold distance (e.g., through D3), the parameter level may vary between the first parameter level and a second parameter level (e.g., through L2). Between the second threshold distance and the intermediate end (e.g., through D4), the parameter level may vary between the second parameter level and 0% (e.g., through L3).

The first segment may be longer than the second segment or the third segment, which may provide a user with finer and slower control over parameter levels using the first segment, and coarser but faster parameter level control when using the second segment or the third segment.

As shown in FIG. 5B, two parameter levels for an electric guitar may be controlled using a single touchpad. For example, in the embodiment of FIG. 8B, a first parameter curve (e.g., a bridge pickup curve) may decrease from 100% to 0% as contact with the touchpad moves from the intermediate start to the intermediate end (e.g., through D2, D3, and D4). The second parameter curve (e.g., a neck pickup curve) may increase from 0% to 100%.

The touchpad may extend along the X-axis, and include a first end (e.g., left side of D1), a second end (e.g., right side of D5), two end zones (D1 and D5), and an intermediate area (D2, D3, and D4). The intermediate area may be further divided into three segments, and may include an intermediate start and an intermediate end. The intermediate start and intermediate end may not have significance with respect to the beginning and/or ending of operations performed using the touchpad, which may begin or end at any point along the touchpad.

For both the first parameter curve and the second parameter curve, the change in parameter level per unit of distance moved along the X-axis may increase as contact with the touchpad is made closer to the second segment, a midpoint, and/or an intersection of the first parameter curve and the second parameter curve. The first and third segments may be longer than (or shorter than, or the same length as) the second segment, and may provide finer and/or slower control over the parameter level per unit of distance traveled along the X-axis than the second segment. The second segment may provide coarser and/or faster control over parameter levels than the first segment and/or the third segment.

FIG. 5C is an illustration of how three parameter levels (e.g., gain levels for electric guitar pickups at different positions, two tone controls, or other variables) may be controlled using a single touchpad that has a first end (e.g., left of D1), a midsection (e.g., D5), and a second end (e.g., right of D9. The touchpad may have a first parameter curve that decreases from 100% to 0% between a first end and the midsection (e.g., through D2, D3, and D4). The touchpad may have a second parameter curve that is at 0% at the first end, at 100% at the midpoint, and at 0% at the second end (e.g., D2 through D8). The touchpad may have a third parameter curve that increases from 0% at the midpoint to 100% at the second end (e.g., through D6, D7, and D8).

The touchpad may include three zones (e.g., D1, D5, and D9) where the parameter levels are fixed to permit a user to more easily set one or more parameter levels. For example, a first zone (e.g., D1) at the first end may permit the user to set the first parameter level at 100% and the other parameter levels at 0%. A second zone (e.g., D5) of the touchpad between the first end and the second end (e.g., at the midpoint) may permit a user to set the second parameter level at 100% and the other parameter levels at 0%. The touchpad may also include a third zone (e.g., D9) that permits the user to set the third parameter level to 100% and the other parameter levels to 0%. The values described are provided by way of example only, and any level between 0% and 100% may be used instead.

Therefore, e.g., the first parameter controlled may be the bridge pickup, the second parameter (middle parameter) may be the middle pickup, and the third parameter may be the neck pickup.

Figure 6A:
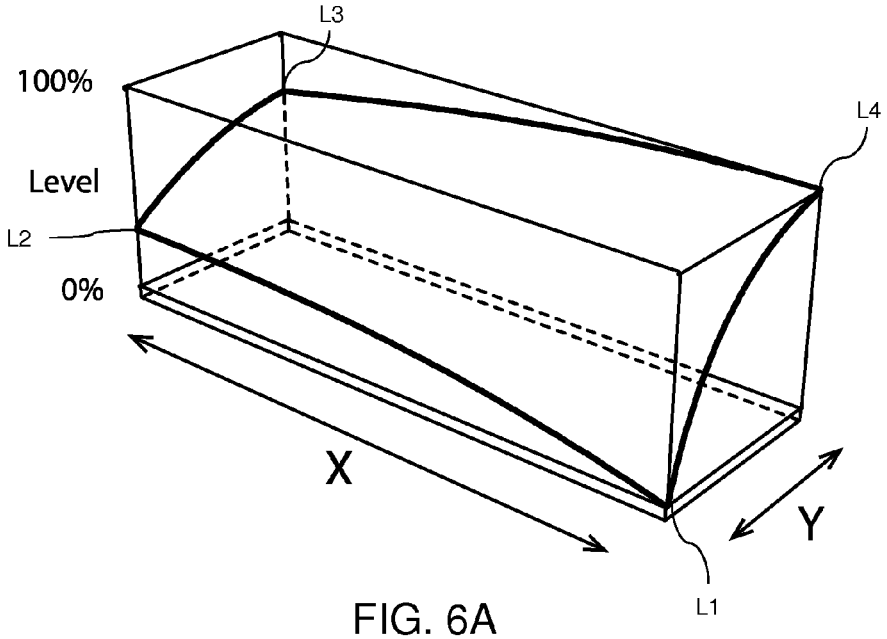
FIGS. 6A and 6B include illustrations of gradient distributions from different perspectives, according to an embodiment.
Figure 6B:
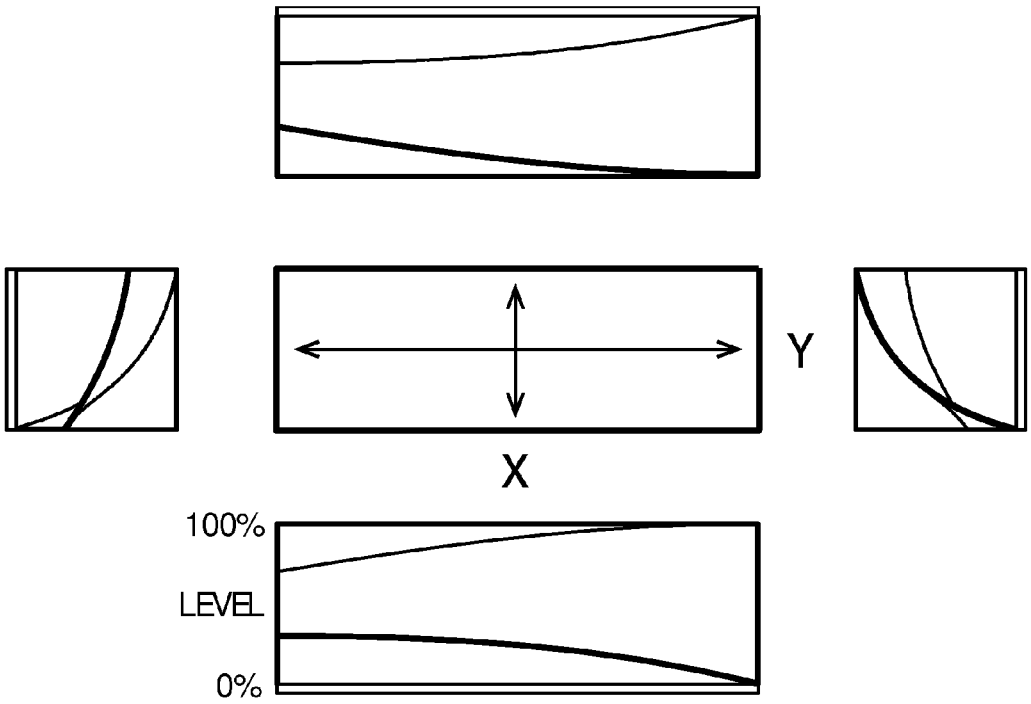

FIGS. 6A and 6B include illustrations of gradient distributions from different perspectives, according to an embodiment.

FIG. 6A is a perspective view of a parameter level surface having three dimensions. FIG. 6A illustrates how X and Y-axis coordinates may be used to control a parameter level. For example, each corner of a rectangular touchpad may correspond to a different parameter level L1, L2, L3, or L4 (e.g., 0%, 30%, 70%, or 100%). The transition between parameter levels may occur as discussed above, with different segments corresponding to finer and/or slower control over a parameter gain level or coarser and/or faster control over a parameter gain level. For example, a user moving their finger across the first edge of the touchpad may cause the parameter level to vary between 0% and 100%, as shown by the parameter curve in the first face. The curve in the first face may be the intersection of the parameter level surface and the ZY-plane containing the first face.

FIG. 6B illustrates the parameter curves of the first face, the second face, the third face, and the fourth face.

Figure 7B:
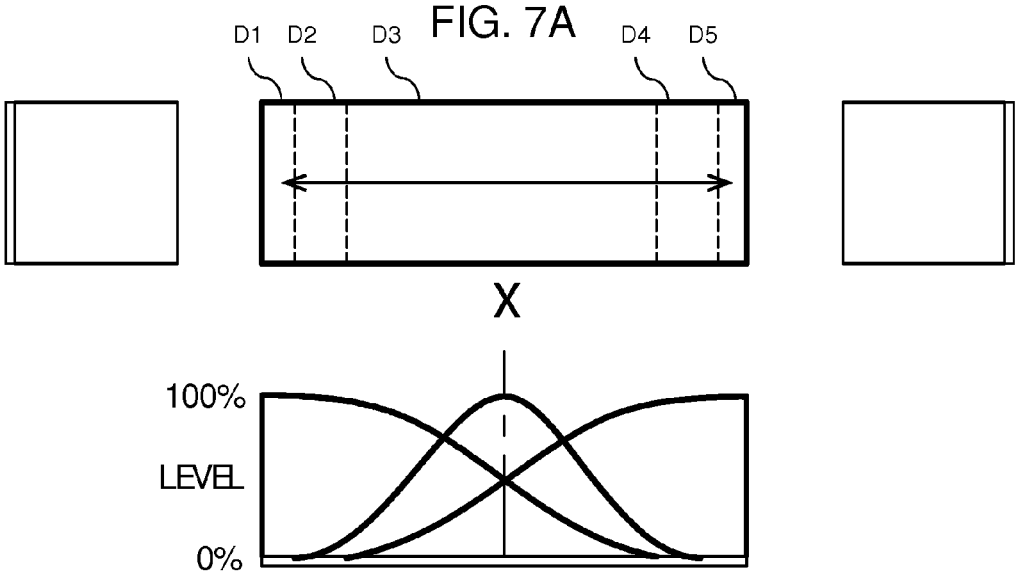

FIGS. 7A and 7B illustrate views of a parameter level surface for a touchpad controlling parameter levels along a single axis for three parameters (e.g., pickups, tone controls), according to an embodiment. As shown, contacting the touchpad and moving along the X-axis will select different parameter levels for the first parameter curve, the second parameter curve, and the third parameter curve. Although the first and second curves are shown as intersecting approximately at the midpoint of the touchpad along the X-axis, the intersection point may be located at different locations in other embodiments. Similarly, the peak of the second parameter curve may be located at the midpoint or at other locations along the X-axis, and may be at the same or different X-axis locations relative to the intersection of the first parameter curve and the third parameter curve.

As shown, the first curve extends through D1, D2, and D3. The second curve extends across D2, D3, and D4. The third curve extends across D3, D4, and D5.

Exemplary Touch Sensor Configurations

Figure 8:
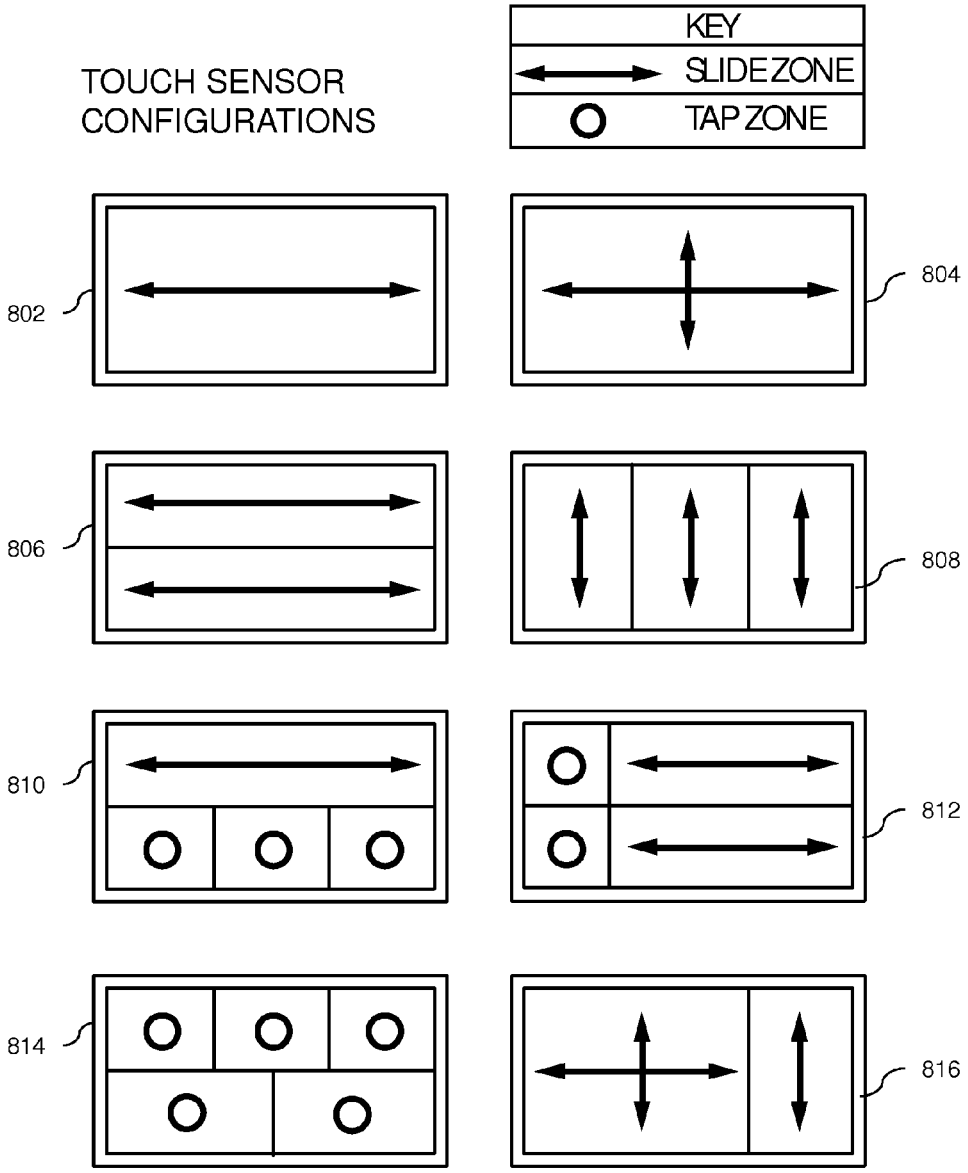
FIG. 8 is an illustration of various touch sensor configurations, according to various embodiments.

FIG. 8 is an illustration of various touch sensor configurations, according to various embodiments.

Configuration 802 recognizes contact along a single axis, with contacts at points perpendicular to the single axis generating the same results. In other words, contact at points at different Y coordinates but the same X coordinate will generate the same output.

Configuration 804 recognizes contact along two perpendicular axes (e.g., an X-axis and a Y-axis). One or more parameters may be controlled by contact with the touch sensor along the X-axis, while one or more of the same and/or different parameters may be controlled by contact with the touch sensor at different Y-coordinates.

Configuration 806 recognizes contact along a X-axis, but differentiates between two different zones along the Y-axis.

Configuration 808 recognizes contact along the Y-axis, but differentiates between three different zones along the X-axis.

Configuration 810 recognizes contact along the X-axis in an upper zone, and may have fixed output values for three tapping zones disposed inside a lower zone below the upper zone.

Configuration 812 includes a tapping zone at the same end of an upper and a lower zone configured to register contact along the X-axis.

Configuration 814 recognizes contact in five different zones.

Configuration 816 recognizes two axis contact in a left zone, and single axis contact in a right hand zone.

Zones may also be referred to as segments or subsegments.

Figure 9:
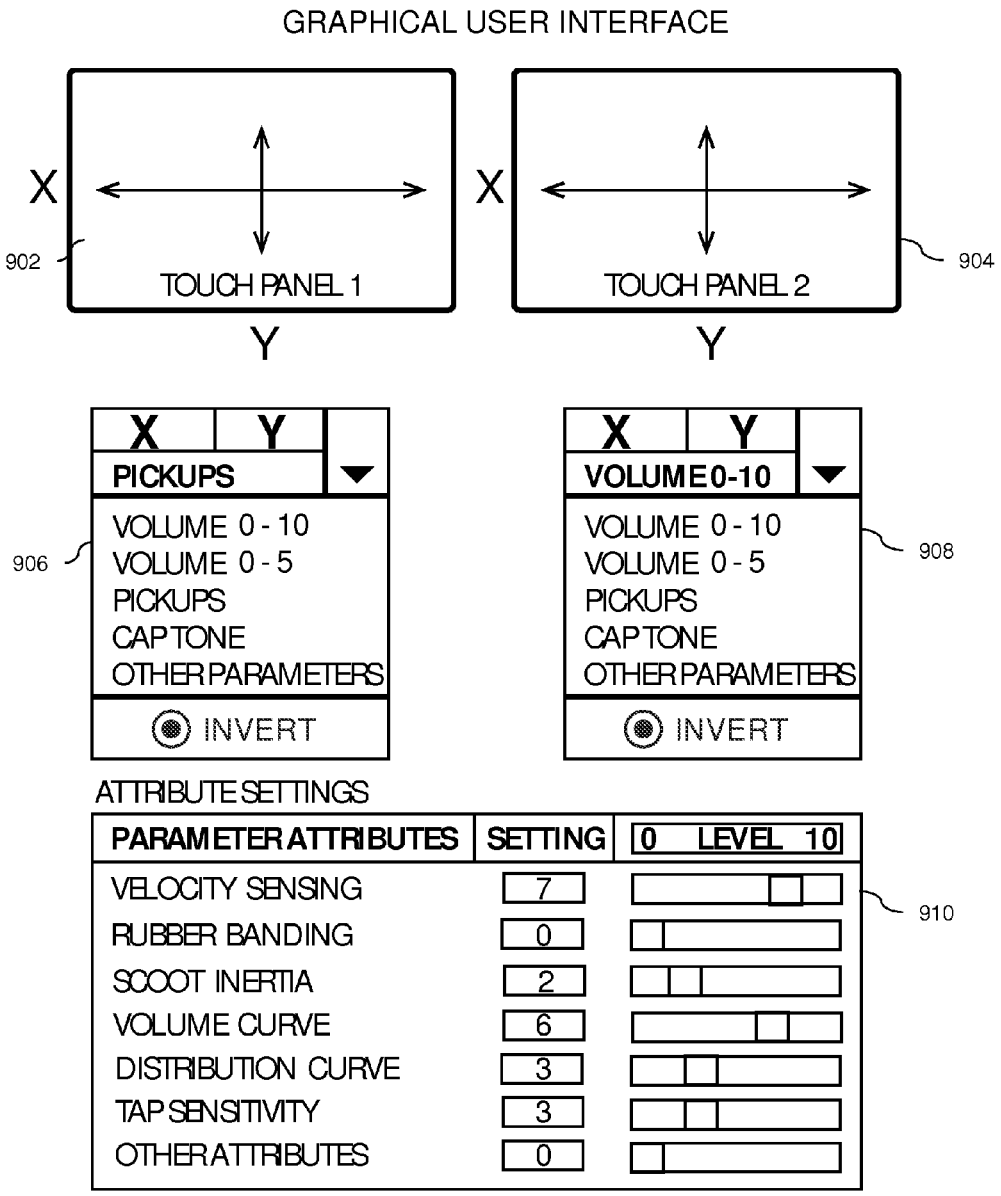
FIG. 9 is an illustration of a graphical user interface, according to an embodiment.

FIG. 9 is an illustration of a graphical user interface, according to an embodiment. FIG. 9 includes representations of a first touch panel 902, a second touch panel 904, parameters 906 for the first touch panel, parameters 908 for the second touch panel, and parameter attributes 910.

FIG. 9 may represent a graphical user interface presented on a laptop, a smart phone, or tablet that communicates with the system via wireless and/or wired connections. A wired connection such as USB may further be used to charge the system.

Parameters 906 may allow a user to select one or more parameters to be controlled by contact along the X or Y axis of the first touch panel. The direction of change may be inverted by selecting an invert radio button. Parameters may include one or more of volume ranging between 0-10 (e.g., maximum) and 0-5, pickup gain for one or more pickups, cap tone, etc. Parameters 908 may control similar parameters for the second touch panel 904.

Parameter attributes 910 may allow a user to set particular attributes at different gain levels. Attributes may include velocity sensing (e.g., how quickly a user is sliding a finger or guitar pick across a touchpad), rubber banding, and scoot inertia (e.g., whether the control allows the user to simulate sliding a finger or other object across the touchpad using a touch and release motion).

Other parameters may be volume curve (e.g., whether a gain curve is made flat/linear or expanded to be less linear), distribution curves (curvature for multiple pickup gain curves), tap sensitivity (how much time is needed to register a contact), or other attributes.

Figure 10A:
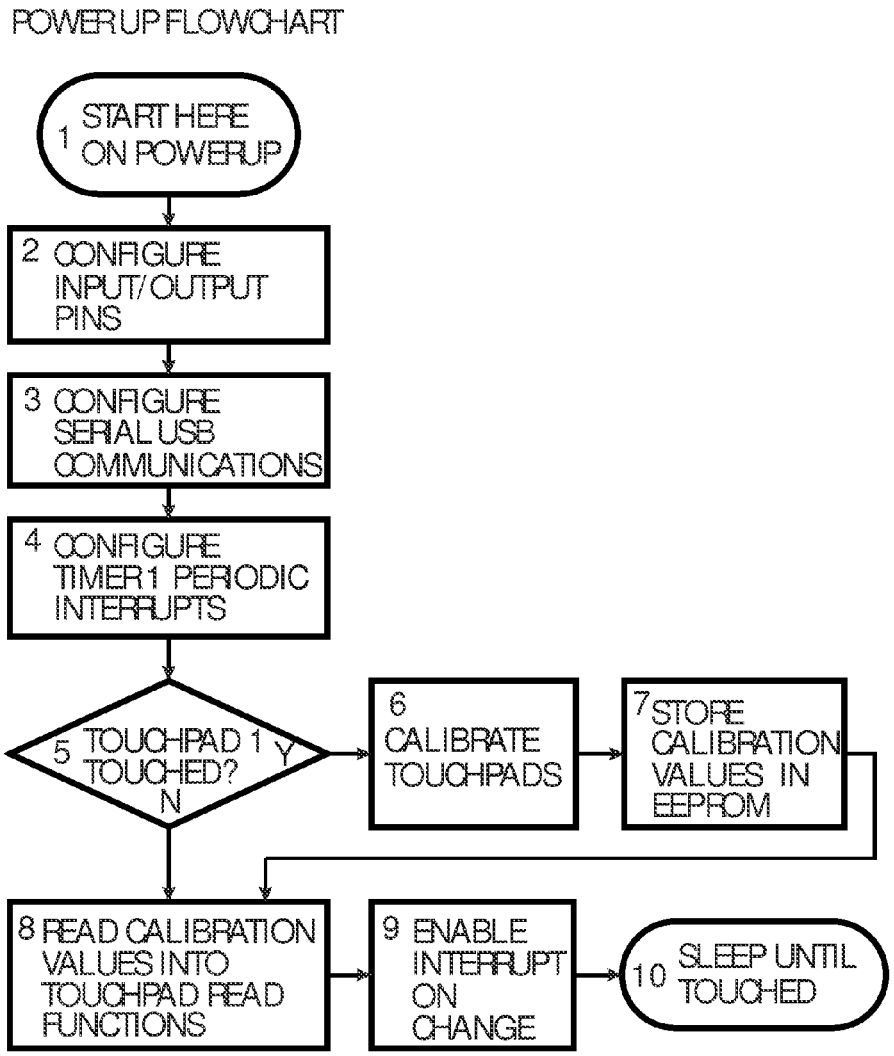
FIGS. 10A and 10B are illustrations of a process flow for controlling touch sensors, according to an embodiment.
Figure 10B:
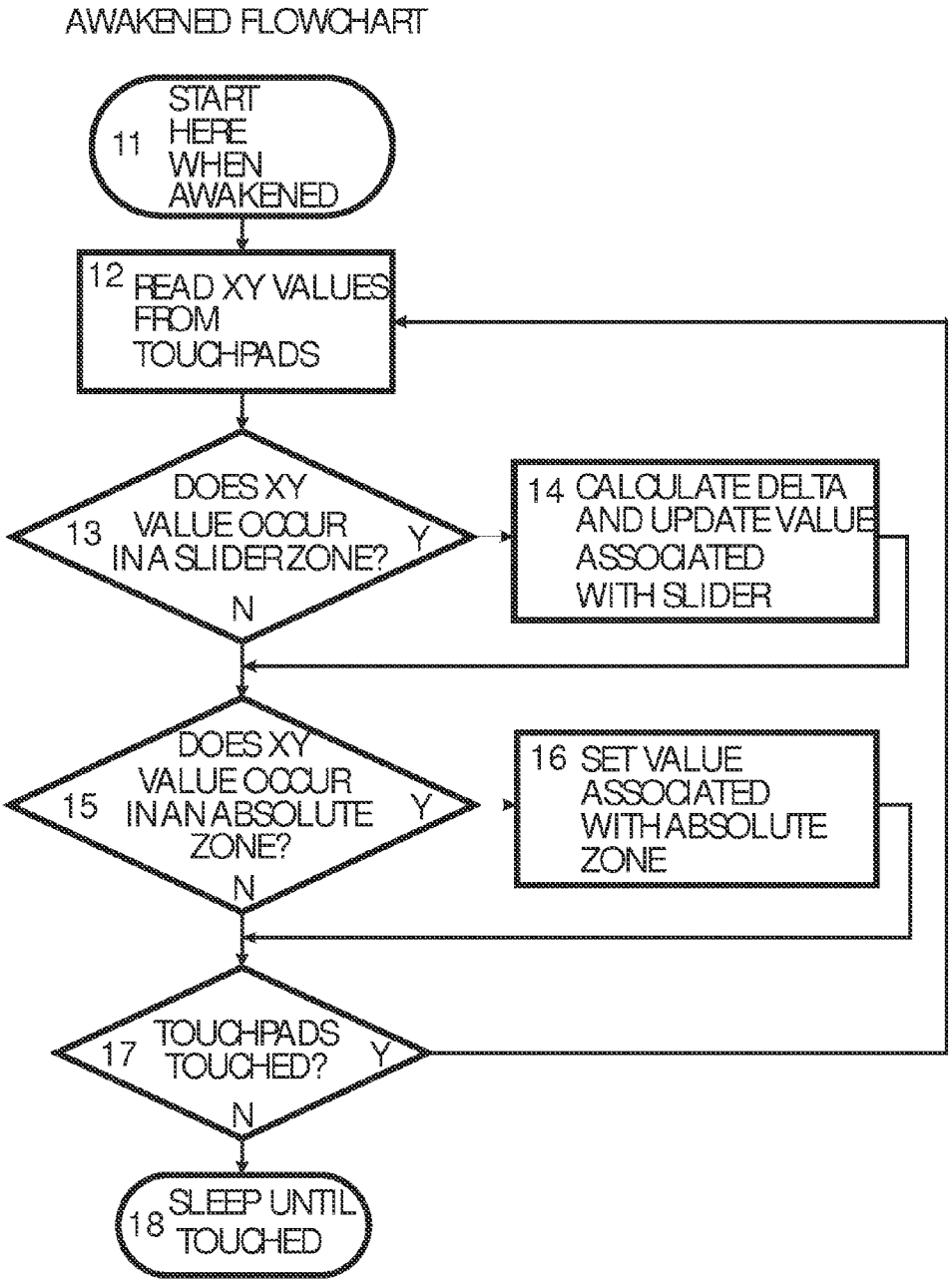

FIGS. 10A and 10B are illustrations of a process flow for controlling touch sensors, according to an embodiment.

The program begins at powerup in block 1. In block 2, I/O pins are configured as either analog inputs, digital inputs, or digital outputs. In block 3, the onboard UART (universal asynchronous receiver transmitter) is configured to 9600,8, N,1 serial protocol for communication to the USB adapter. In block 4, TIMER 1 is configured to interrupt the CPU periodically as a general purpose timer.

Block 5 tests if touchpad 1 is touched, if it is, the calibrate touchpad sequence is executed in 6, and the results stored in EEPROM in 7. Block 8 reads values from touchpad calibration values from EEPROM for use in the touchpad reading functions. These calibration values map touchpad inputs into floating point values between 0.0 and 1.0. Block 9 configures an interrupt to be generated when the touchpads are touched with a stylus or finger. Block 10 sets the CPU into a low power sleep mode from which it can be awakened with an interrupt.

The program continues at block 11 when awakened by an interrupt. Block 12 reads the XY values from the touchpads. Block 13 determines if the touch was in a slider zone which is a relative command. Block 14 calculates the delta from the previous reading and updates the associated value. For example if the volume slider was touched, the previous touch value is subtracted from the current value, and the resulting delta is used to update the volume register.

Block 15 determines if the touch was in an absolute zone. Block 16 sets the associated value independent of any previous readings. For example if the neck pickup zone is touched the neck pickup is set to 100% and all other pickups turned off.

Block 17 test if a touchpad is touched. If not block 18 puts the CPU to sleep mode. If yes, execution is returned to block 12 and the sequence repeats.

Exemplary Systems

Figure 11:
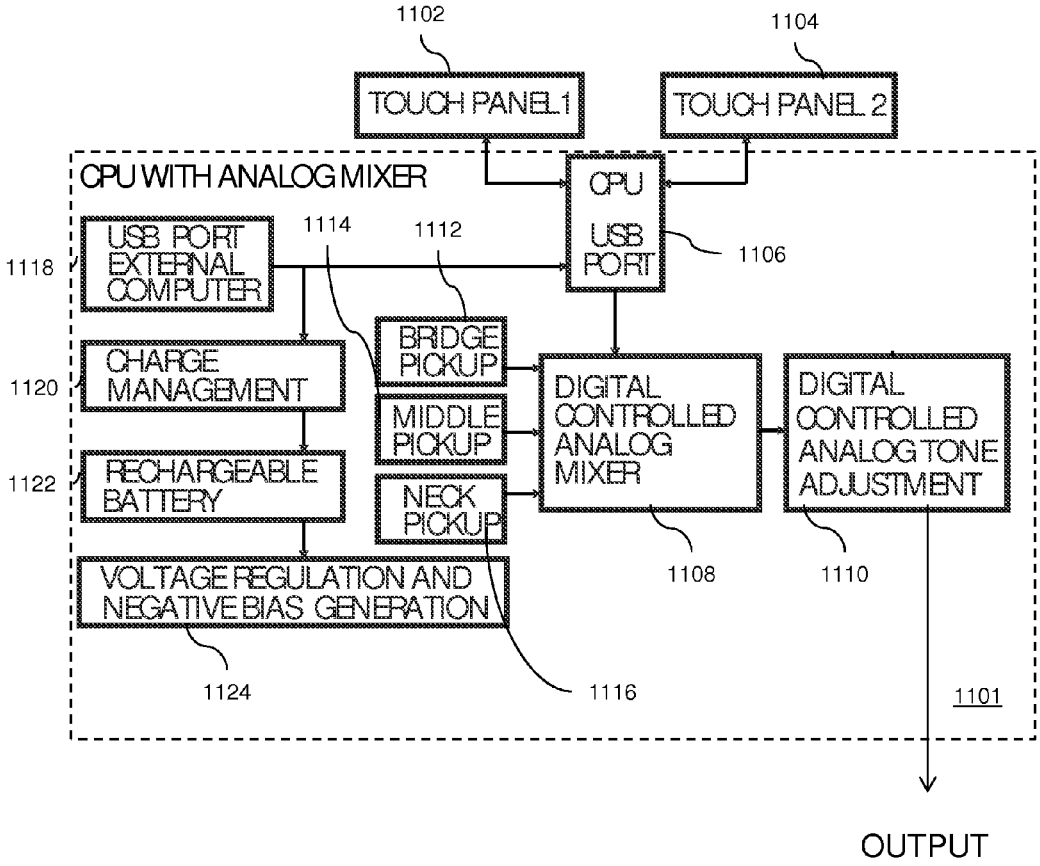
FIG. 11 is a block diagram of an analog-based system, according to an embodiment.

FIG. 11 is a block diagram of an analog-based system, according to an embodiment. FIG. 11 includes control unit 1101, touch panel 1 1102 and touch panel 2 1104, CPU 1106, analog mixer 1108, analog tone adjustment 1110, bridge pickup 1112, middle pickup 1114, and neck pickup 1116. Also included are USB port 1118, charge management 1120, rechargeable battery 1122, and voltage regulation 1124.

In the embodiment, TouchPanel 1 and TouchPanel 2 are of the four wire resistive variety. Error in the readings can be reduced by oversampling and averaging. Audio inputs from guitar string pickups are connected to a digitally controlled analog mixer which is configured from three digital potentiometers. A quad digital potentiometer such as the integrated circuit from Analog Devices, the AD5263BRU200 quad digital potentiometer, is suitable for this purpose and conveniently contains four potentiometers in one package of a resistance value typical for use in legacy guitar potentiometer circuitry. The combined audio inputs are passed through a tone control configured with the fourth digital potentiometer of the AD5263BRU200 and an output is provided for external amplification.

Parameters used in the software can be adjusted via a USB port on the CPU provided with a connection to an external computer. USB power is also used to provide charging power for a rechargeable battery. A charge management system, voltage regulation and generation system provide proper charge current and voltage and provide the digital and analog voltages needed by the various components in the system.

Figure 12:
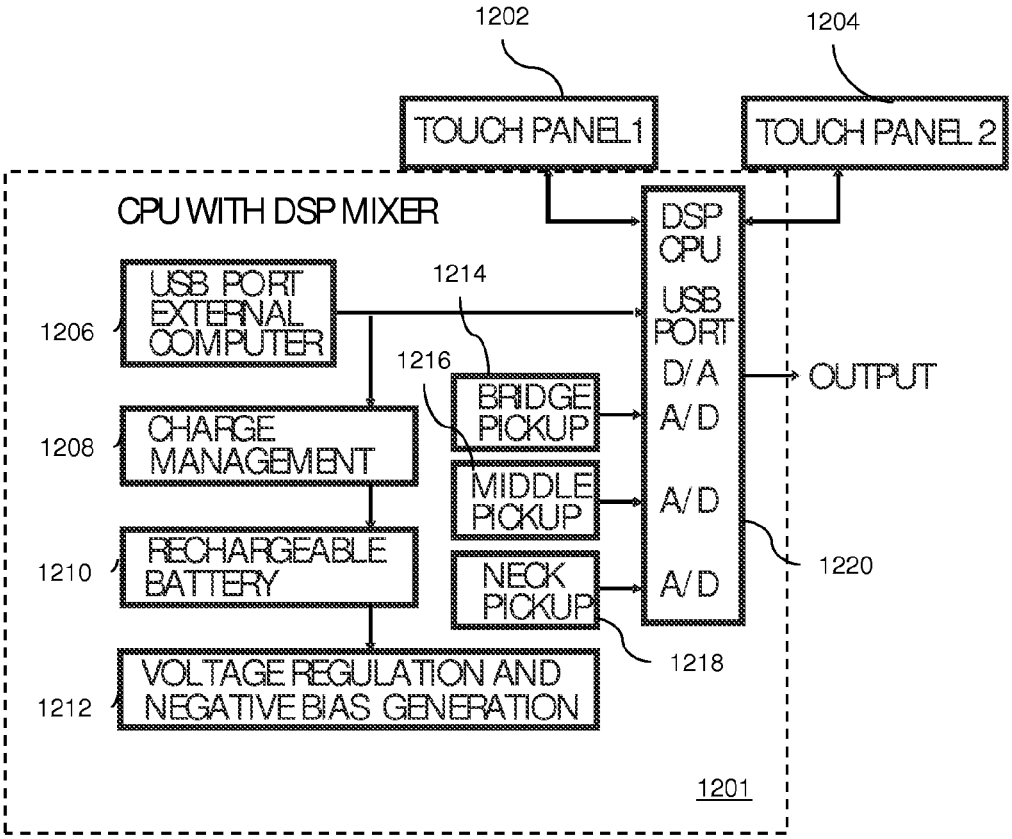
FIG. 12 is a block diagram of a digital system processing based system, according to an embodiment.

FIG. 12 is a block diagram of a digital system processing based system, according to an embodiment. FIG. 12 includes control unit 1201, touch panel 1 1202, touch panel 2 1204, USB port 1206, charge management 1208, rechargeable battery 1210, voltage regulation 1212, bridge pickup 1214, middle pickup 1216, neck pickup 1218, and DSP CPU 1220.

In the embodiment, audio inputs from guitar string pickups are digitized A/D converters. DSP techniques can be used to combine and adjust the tone of the audio inputs. Additional audio effects such as distortion, delay and reverberation can be added by DSP techniques.

Parameters used in the software can be adjusted via a USB port on the CPU provided with a connection to an external computer. USB power is also used to provide charging power for a rechargeable battery. A charge management system, voltage regulation and generation system provide proper charge current and voltage and provide the digital and analog voltages needed by the various components in the system.

Exemplary Gain Functions

Figure 13:
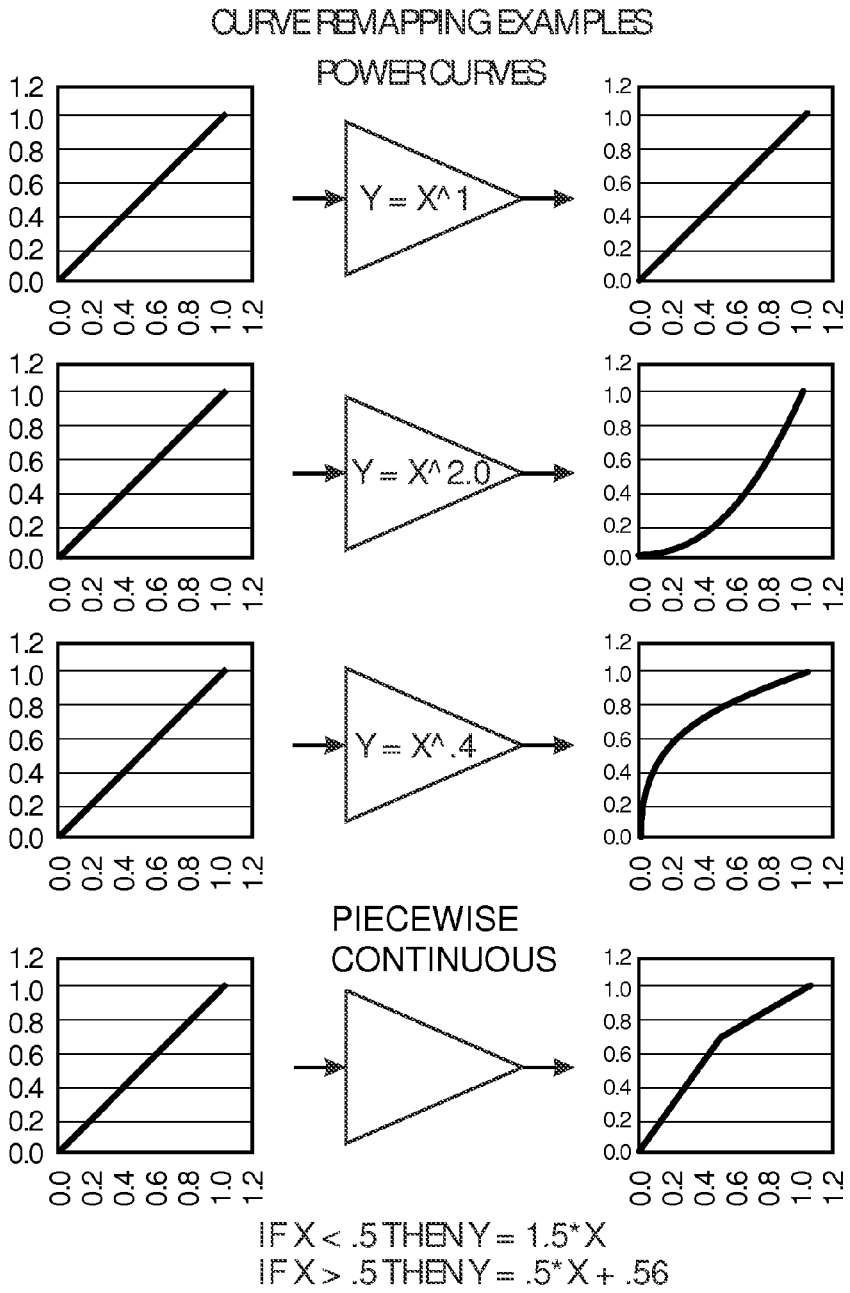
FIG. 13 are illustrations of exemplary functions for converting position sensing to an output gain, according to various embodiments.

FIG. 13 are illustrations of exemplary functions for converting position sensing to an output gain, according to various embodiments. It is desirable that the volume of the audio outputted by the circuitry should result in desired output, which may be linear or nonlinear. In addition, the sensing performance and output of electronic components such as magnetic pickups may not behave or combine in a linear way.

Exemplary gain functions that may be applied to different parameters include a linear function that is mapped into a linear function with a power curve of 1. In example 2a linear function is mapped into a non-linear function with a power curve of 2.0. In example 3a linear function is mapped into a non-linear function with a power curve of 0.4. The bottom example illustrates a piecewise continuous mapping, which is used in this instance to create two different linear mappings with different gain levels for the same parameter(s). The parameters controlling the remapping can be adjusted by the user via the USB connection to an external computer.

Exemplary Mounting Methods

Figure 14A:
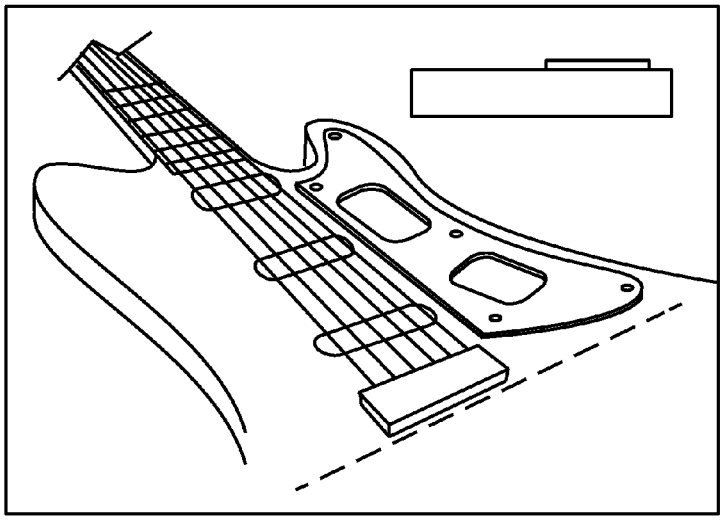
FIGS. 14A, 14B, and 14C illustrate various mounting methods of the system, according to various embodiments.
Figure 14B:
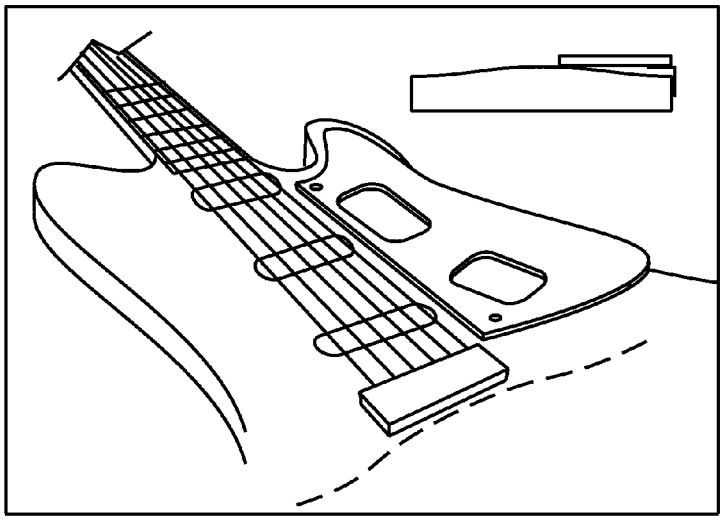
Figure 14C:
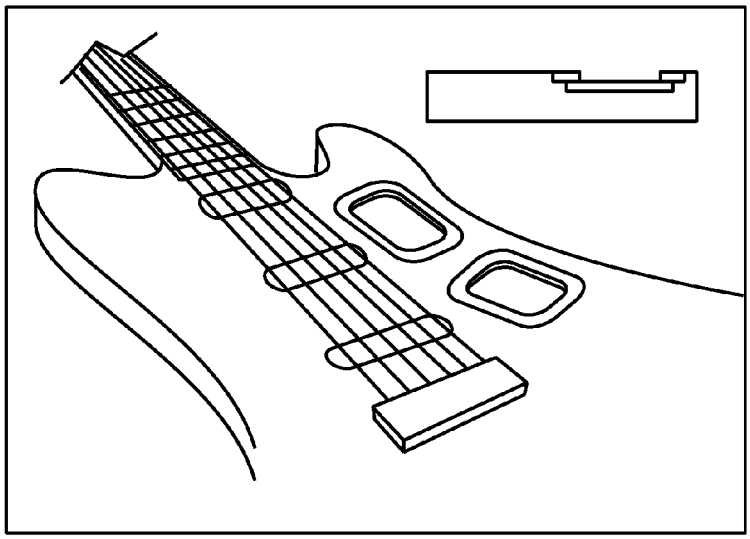

FIGS. 14A, 14B, and 14C illustrate various mounting methods of the system, according to various embodiments. FIG. 14A illustrates a system that includes a screwed down pickguard on a flat guitar body. FIG. 14B includes a floating pickguard on a contoured (non-flat) guitar body. FIG. 14C illustrates a system that is inlaid into the body of a guitar, which may include a bezel.

Figure 15A:
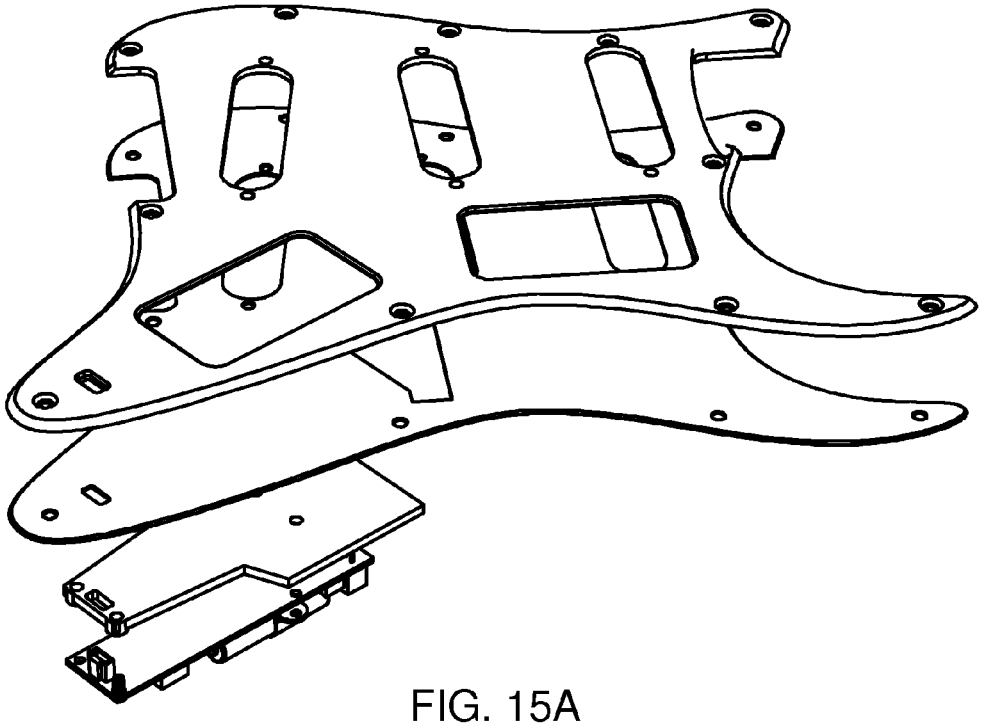
FIGS. 15A and 15B are exploded perspective views of the system, according to an embodiment.
Figure 15B:
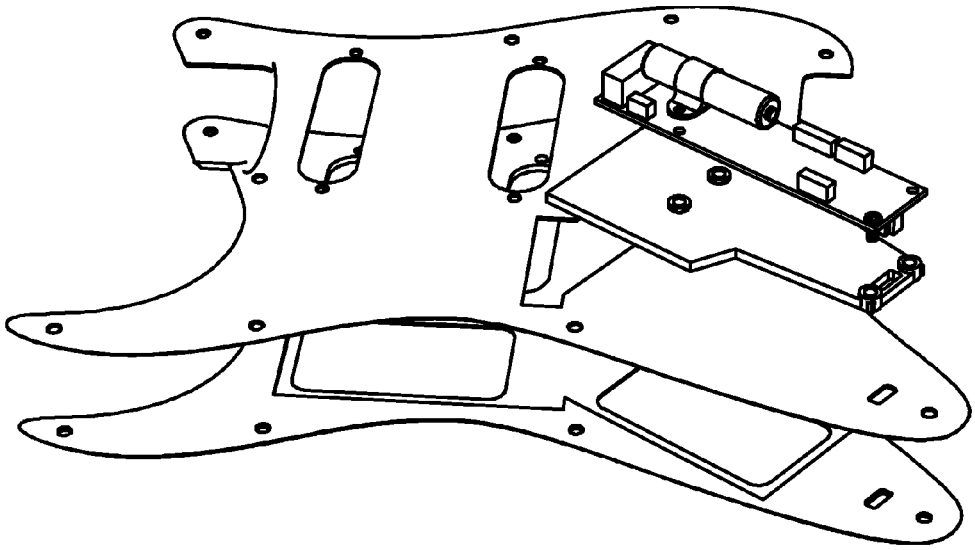
Figure 16A:
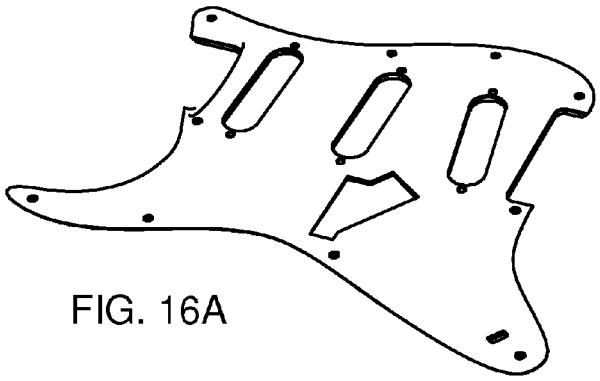
FIGS. 16A, 16B, 16C, and 16D illustrate installation of a touch sensor in a pickguard, according to an embodiment.
Figure 16B:
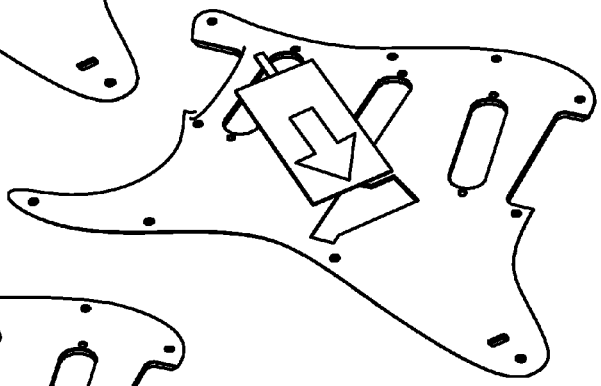
Figure 16C:
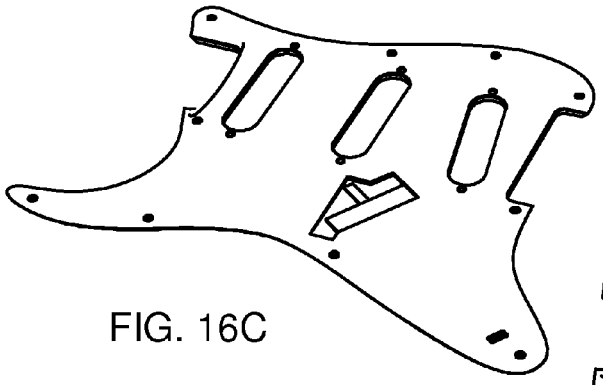
Figure 16D:
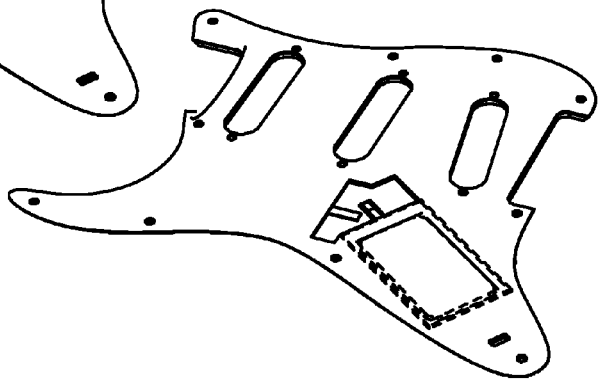

FIGS. 15A and 15B are exploded perspective views of the system, according to an embodiment.

FIGS. 16A, 16B, 16C, and 16D illustrate installation of a touch sensor in a pickguard, according to an embodiment.

Figure 17:
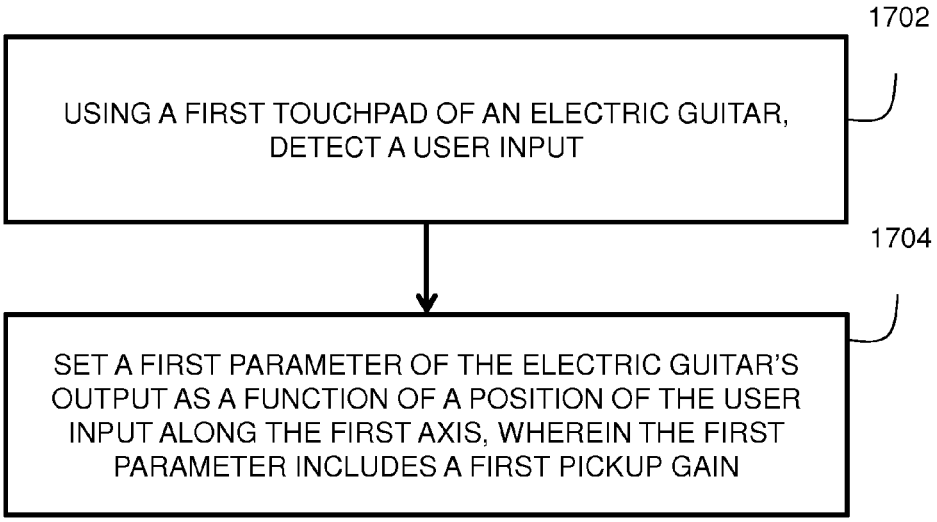
FIG. 17 is a process flow for controlling a parameter of an electric guitar, according to an embodiment.

FIG. 17 is a process flow for controlling a parameter of an electric guitar, according to an embodiment. In operation 1702, the system uses a first touchpad (e.g., touchpad 102) of an electric guitar to detect a user input. In operation 1704, the system sets a first parameter of the electric guitar's output as a function of a position of the user input along the first axis, wherein the first parameter includes a first pickup gain. The first pickup gain may apply to a bridge pickup, a middle pickup, or a neck pickup. Other parameters may include volume, or tone.

Exemplary Computing System

Figure 18:
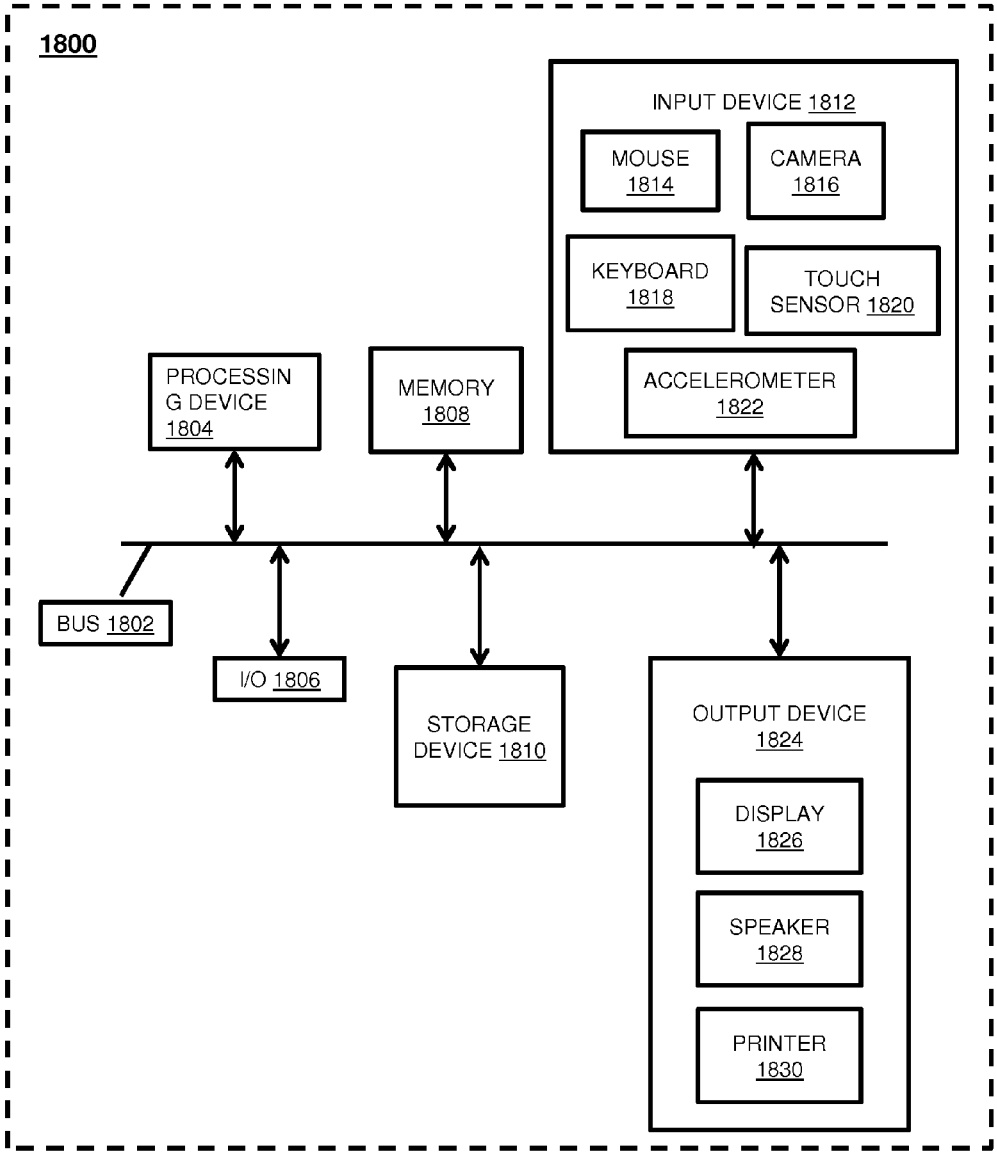
FIG. 18 is a block diagram of an exemplary computing system, according to an embodiment.

FIG. 18 is a block diagram of an exemplary computing system 1800 (e.g., for a mobile device, tablet, laptop computer, or desktop computer) that may be used to communicate with the control unit, such as for programming parameters or charging the control unit's power system via a USB. The computing system 1800 may include one or more of each of bus 1802, processing device 1804, I/O 1806, memory 1808, storage device 1810, input device 1812, mouse 1814, camera 1816, keyboard 1818, touch sensor 1820, accelerometer 1822, output device 1824, display 1826, speaker 1828, and printer 1830.

The processing device 1804 may include a conventional processor or microprocessor that is configured to interpret and execute a set of instructions. The processing device 1804 may communicate with each of the other components in the computing device 1800 via the bus 1804, such to obtain instructions stored in the memory 1808 and/or the storage device 1810. The processing device 1804 may further be configured to receive inputs from the input device 1802, and to provide outputs via the output device 1824. The bus 1804 may permit communication between the components of the computing device 1800.

The memory 1808 may include RAM and/or ROM. The storage device 1810 may include magnetic hard drives, flash media, magnetic media, optical media, or another type of physical device that stores information for the processing device 1804. The storage device 1810 may include tangible machine-readable media and/or the corresponding drive for reading and/or writing to the machine-readable media. The memory 1808 and/or the storage device 1810 may store a set of instructions detailing a method that when executed by one or more processing devices cause the one or more processing devices to perform the method.

The input device 1812 may be used by a user to provide information to the processing device 1804. The input device 1812 may include one or more of the mouse 1814, camera 1816, keyboard 1818, touch sensor 1820, and/or accelerometer 1822. The output device 1824 may be used by the processing device 1804 to provide audio and/or visual output to one or more users. The output device 1824 may include the display 1826, speaker 1828, and printer 1830.

The I/O 1806 may be any device that permits the processing device 1804 to communicate with other devices and/or networks. For example, the I/O 1806 may include a modem, a network card, or other interface. The I/O 1806 may permit communication with wired, wireless, and/or optical systems (e.g., Bluetooth, USB, etc.). The I/O 1806 may further permit peripheral devices to be connected to the computing device 1800, or to pair the computing device 1800 with other computing devices.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods within the scope and spirit of the invention.

In addition, although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. An electric guitar interface system, comprising:

a first touchpad of an electric guitar configured to detect a user input; and a control unit coupled to the first touchpad, the control unit being configured to set a first parameter of the electric guitar's output as a function of a position of the user input along the first axis, wherein the first parameter includes a first pickup gain, wherein the length of the first touchpad along the first axis includes a first segment in which the first corresponding value varies along the first axis, wherein the first segment includes a first subsegment and a second subsegment, and wherein a range of the first corresponding value is greater in the second subsegment than in the first subsegment.

2. The electric guitar interface system of claim 1, wherein the first pickup gain is for at least one of a bridge pickup, a middle pickup, and a neck pickup.

3. The electric guitar interface system of claim 1, wherein the first parameter includes a second pickup gain.

4. The electric guitar interface system of claim 1, wherein the first parameter includes a third pickup gain.

5. The electric guitar interface system of claim 1, wherein the control unit is configured to control a second parameter of the electric guitar's output as a function of the position of the user input along the second axis.

6. The electric guitar interface system of claim 5, wherein the second parameter is one of volume and tone.

7. The electric guitar interface system of claim 1, further comprising:

a touchpad housing that comprises at least one of a pickguard, an inlay, and an underlay.

8. The electric guitar interface system of claim 1, wherein the first corresponding value varies nonlinearly with respect to the position of the user input along the first axis.

9. The electric guitar interface system of claim 1, wherein the first segment includes a third subsegment that is adjacent to the second segment and has the same length as the first subsegment and the second subsegment, wherein the range of the first corresponding value is greater in the third subsegment than in the second subsegment.

10. The electric guitar interface system of claim 1, wherein the first segment includes a third subsegment that is adjacent to the second segment and has the same length as the first subsegment and the second subsegment, wherein the range of the first corresponding value is smaller in the third subsegment than in the second subsegment.

11. The electric guitar interface system of claim 1, wherein the first subsegment and the second subsegment each have the same length and are adjacent to each other.

12. The electric guitar interface method of claim 1, wherein the length of the first touchpad along the first axis includes a zone that is connected with the first subsegment, and wherein the first corresponding value is constant for the length of the zone along the first axis.

13. An electric guitar interface method, comprising:

using a first touchpad of an electric guitar, detecting a user input; and setting a first parameter of the electric guitar's output as a function of a position of the user input along the first axis, wherein the first parameter includes a first pickup gain, and wherein the length of the first touchpad along the first axis includes a first segment in which the first corresponding value varies along the first axis, wherein the first segment includes a first subsegment and a second subsegment, and wherein a range of the first corresponding value is greater in the second subsegment than in the first subsegment.

14. The electric guitar interface method of claim 13, wherein the first pickup gain is for at least one of a bridge pickup, a middle pickup, and a neck pickup.

15. The electric guitar interface method of claim 13, wherein the first parameter includes a second pickup gain.

16. The electric guitar interface method of claim 13, wherein the control unit is configured to control a second parameter of the electric guitar's output as a function of the position of the user input along the second axis.

17. The electric guitar interface method of claim 16, wherein the second parameter is one of volume and tone.

18. A non-transitory tangible machine-readable medium having a set of instructions stored thereon that when executed by one or more processing devices cause the one or more processors to perform the method, the method comprising:

using a first touchpad of an electric guitar, detecting a user input; and setting a first parameter of the electric guitar's output as a function of a position of the user input along the first axis, wherein the first parameter includes a first pickup gain, and wherein the length of the first touchpad along the first axis includes a first segment in which the first corresponding value varies along the first axis, wherein the first segment includes a first subsegment and second subsegment, and wherein a range of the first corresponding value is greater in the second subsegment than in the first subsegment.

19. The non-transitory tangible machine-readable medium of claim 18, wherein the first pickup gain is for at least one of a bridge pickup, a middle pickup, and a neck pickup.

20. The non-transitory tangible machine-readable medium of claim 18, wherein the first parameter includes a second pickup gain.

* * * * *